US005352322A

United States Patent [19]

Leverick

[11] Patent Number: 5,352,322

[45] Date of Patent: Oct. 4, 1994

[54] ADHESIVE APPLICATOR APPARATUS

[75] Inventor: Paul D. Leverick, Rotherham, England

[73] Assignee: C. B. Kaymich & Company Limited, United Kingdom

[21] Appl. No.: 944,901

[22] Filed: Sep. 15, 1992

[30] Foreign Application Priority Data

Sep. 23, 1991 [GB] United Kingdom ..... 9120239

[51] Int. Cl.[5] ..... B65C 11/04

[52] U.S. Cl. ..... 156/578; 118/244; 118/261; 156/546

[58] Field of Search ..... 156/546, 578; 118/244, 118/261; 427/211, 428

[56] References Cited

U.S. PATENT DOCUMENTS

| | | | |
|---|---|---|---|
| 2,641,220 | 6/1953 | Weber et al. | 118/261 X |
| 3,013,527 | 12/1961 | Novick | 118/244 X |
| 3,389,684 | 6/1968 | Talbot . | |
| 4,043,657 | 8/1977 | Karnik | 118/261 X |
| 4,416,722 | 11/1983 | Bergman et al. | 156/578 |
| 4,718,373 | 1/1988 | Zodrow | 118/262 |

FOREIGN PATENT DOCUMENTS

| | | |
|---|---|---|
| 352276 | 4/1922 | Fed. Rep. of Germany . |
| 430133 | 6/1926 | Fed. Rep. of Germany . |
| 1296559 | 5/1969 | Fed. Rep. of Germany . |
| 3614582 | 11/1987 | Fed. Rep. of Germany . |

*Primary Examiner*—David A. Simmons
*Assistant Examiner*—Paul M. Rivard
*Attorney, Agent, or Firm*—Stevens, Davis, Miller & Mosher

[57] ABSTRACT

The invention relates to an adhesive applicator apparatus having an adhesive applicator roller (16) rotatable in an adhesive tank (12) and a doctor blade assembly (18) associated with the applicator roller.

So that the adhesive in the tank does not become aerated, the applicator roller (16) is located wholly above the level of adhesive in the tank (12), and a rotatable pick-up disc (20) is provided to feed adhesive to a receiving reservoir (24) formed in the doctor blade assembly (18).

11 Claims, 3 Drawing Sheets

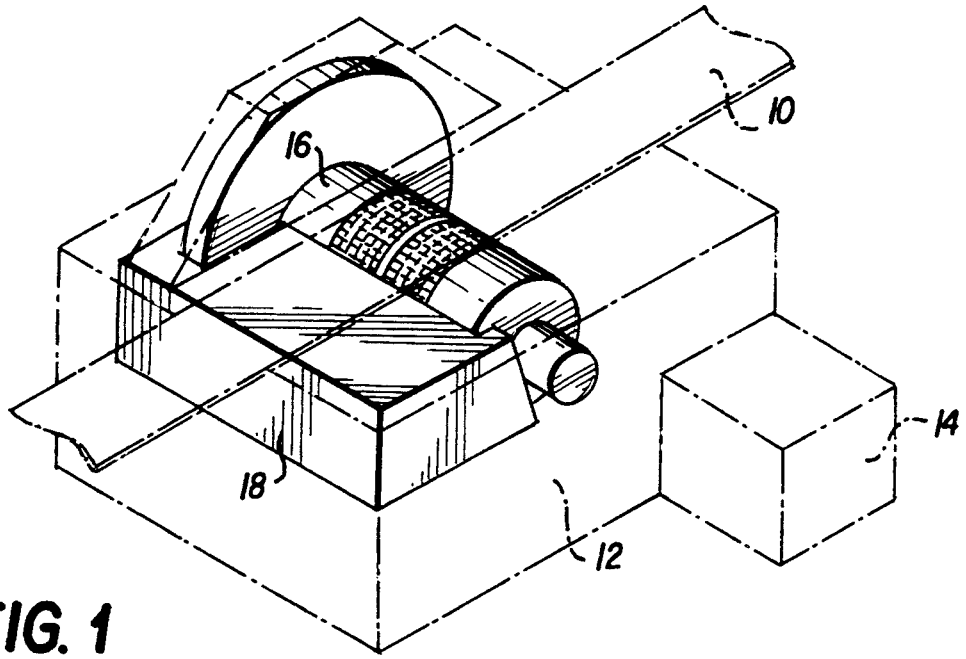
FIG. 1
FIG. 2
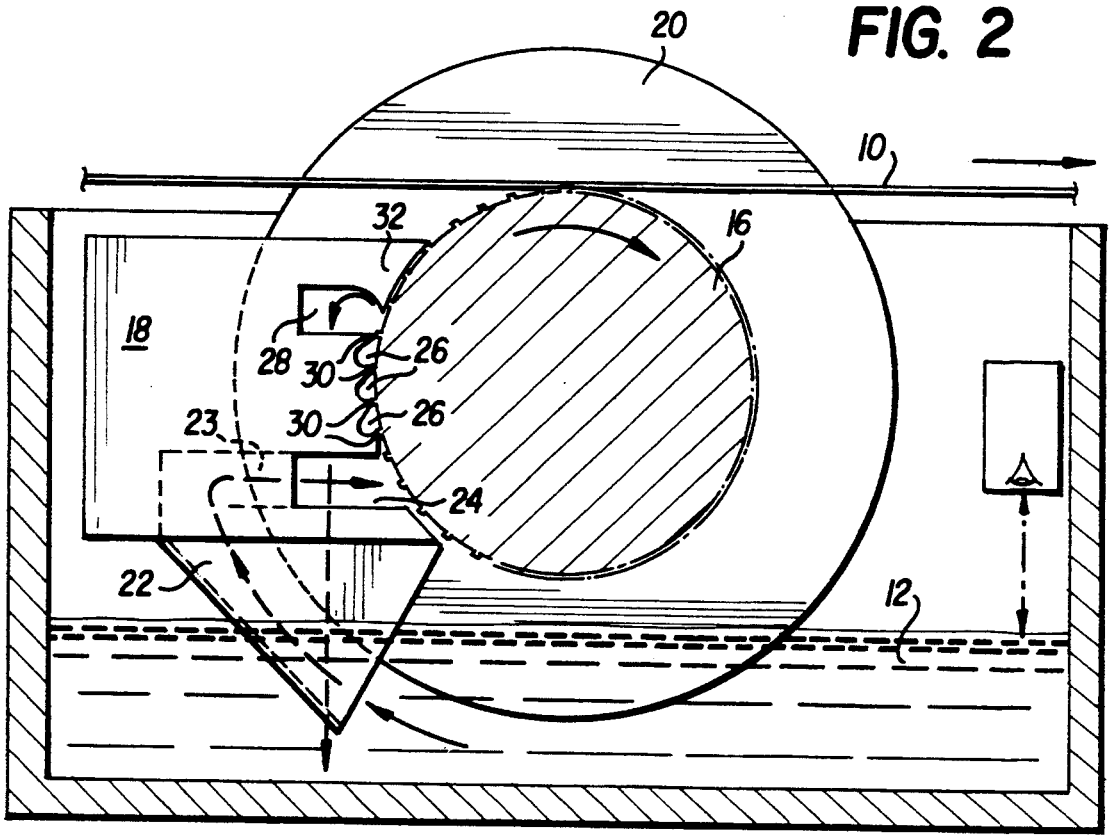

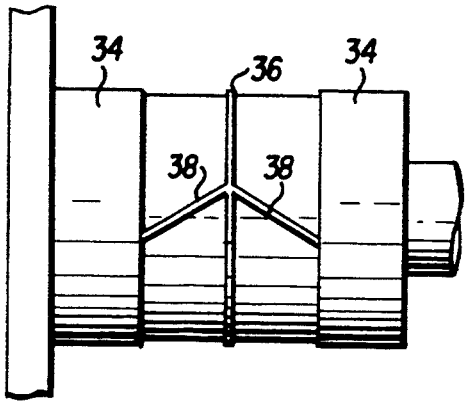
FIG. 3
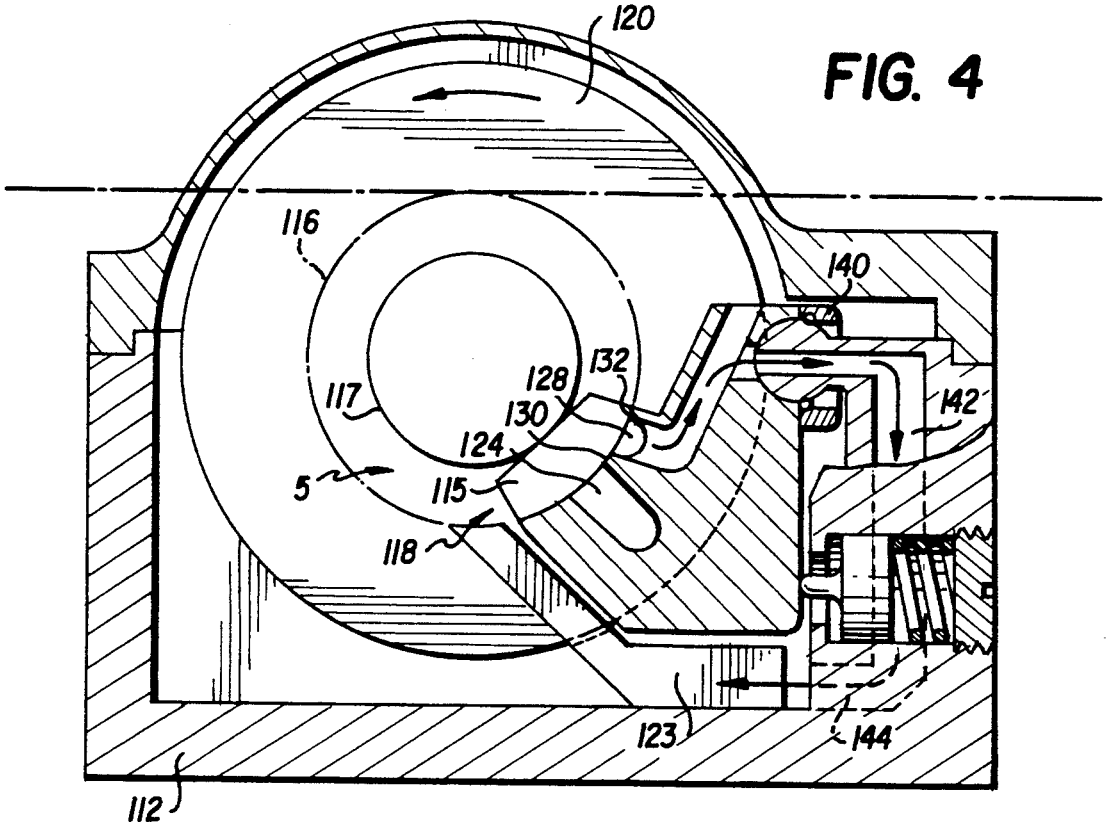
FIG. 4
FIG. 5
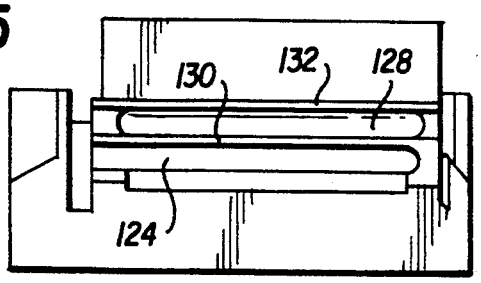

ADHESIVE APPLICATOR APPARATUS

FIELD OF THE INVENTION

The invention relates to adhesive applicator apparatus primarily but not exclusively for use in association with cigarette making machinery.

Various kinds of adhesive applicator apparatus for spreading adhesive evenly across a paper web are in use at present in a variety of industries. However, most of these suffer from at least one of several common drawbacks. For example, in the kind of adhesive applicator apparatus having an adhesive pick-up roller partly immersed in a quantity of adhesive, and having a doctor blade spaced from an operative part of the pick-up roller to produce an even thickness of adhesive on said operative part, one particular drawback is that the constant entry of the roller surface into the adhesive carries with it a quantity of air which tends to aerate the adhesive so that this causes problems in connection with its even distribution across the paper web. A further drawback is that if a particle of material, be it of grit or of solidified adhesive for example, becomes lodged in the gap between the operative part of the pick-up roller and the doctor blade, this produces a dry line around the pick-up roller and a dry line along the subsequently coated paper web.

Another drawback of most known types of adhesive applicator apparatus is that changes of viscosity of the adhesive being used can seriously affect the operation of the apparatus.

The invention has for its object to provide an adhesive applicator apparatus which will at least alleviate these problems.

SUMMARY OF THE INVENTION

According to the invention, there is provided adhesive applicator apparatus including a rotatable applicator roller, an adhesive tank for the supply of adhesive to the roller, and a doctor blade assembly associated with said applicator roller, the applicator roller being located wholly above the level of adhesive in said tank and the apparatus also including an adhesive pick-up disc for feeding adhesive in the tank to a receiving reservoir associated with the doctor blade assembly. The pick-up disc may be associated with and rotate with the applicator roller. At least one doctor blade assembly may be disposed between a slot which forms the receiving reservoir and a further slot which forms an adhesive return reservoir for the return of excess adhesive to the supply of adhesive in the adhesive tank. Between the slots which form the receiving and return reservoirs there may be at least one groove above and below which are lands which constitute primary doctor blades spaced from the operative part of the applicator roller, and immediately above the slot forming the adhesive return reservoir there may be a final doctor blade.

A part of the pick-up disc may be flanked by a U-shaped element forming a channel for the flow of adhesive into the slot comprising the receiving reservoir.

The apparatus may include an adhesive pick-up limiting doctor blade associated with the pick-up disc.

The doctor blade or blades associated with the applicator roller may be located by means of pivotal mounting means within the adhesive tank and abut against resiliently mounted abutment means. Said pivotal mounting means may comprise at least two laterally spaced ball and socket arrangements. Adhesive return passages may extend through said pivotal mounting means to a lower region of the adhesive tank. Said doctor blade or blades may be acted on by resilient means for urging it or them towards the applicator roller.

The applicator roller may be provided with at least one angled ridge extending across an operative part thereof at the doctor blade contacting diameter of said roller, for sweeping sideways particles of material reaching said operative part. There may be at least one pair of angled ridges extending in chevron fashion along the applicator roller.

BRIEF DESCRIPTION OF THE DRAWINGS

FIG. 1 is a schematic perspective view of adhesive applicator apparatus embodying the invention, FIG. 2 is a diagrammatic side view of the apparatus, and FIG. 3 is a detail of construction which will be referred to, FIG. 4 is a view similar to FIG. 2 and illustrating a different embodiment of the invention, FIG. 5 is a view of a component part of the apparatus, looking in the direction of arrow 5 in FIG. 4.

DESCRIPTION OF THE PREFERRED EMBODIMENT

Figure 6:
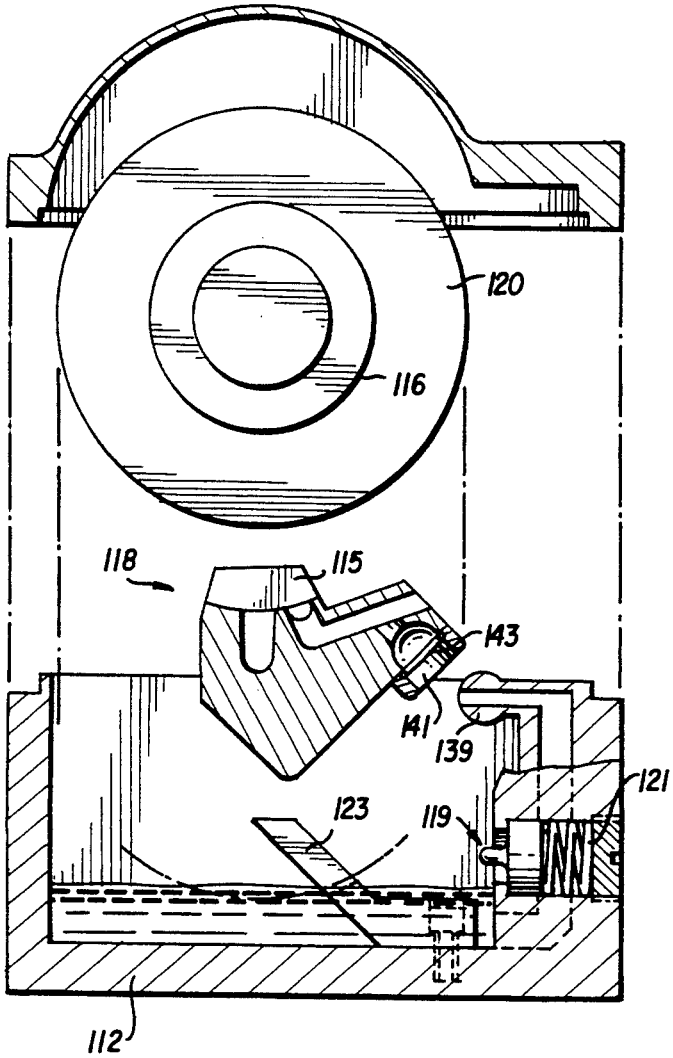
FIG. 6 is an exploded view of the apparatus.

Referring now to FIGS. 1 to 3 of the drawings, the apparatus there illustrated is an adhesive applicator apparatus for use in association with cigarette making machinery. It is provided for spreading adhesive evenly across a paper web 10 to be used for applying filters to cigarettes.

The apparatus includes an adhesive tank 12, a level control assembly 14 communicating with said tank, an applicator roller 16, and a doctor blade assembly, generally indicated 18, mounted in the tank to act against the applicator roller.

Referring in particular to FIG. 2, it will be seen that although the applicator roller 16 is rotatably mounted in the tank it is located wholly above the level of the adhesive in said tank. However, at one end of the applicator roller there is located an adhesive pick-up disc 20 which is arranged to rotate with said roller, the pick-up disc being partly immersed in the adhesive. A portion of the pick-up disc is flanked by a U-shaped element 22 depending from the doctor blade assembly 18, said U-shaped element forming a channel up which the disc 20 propels a quantity of adhesive which is then able to flow into a slot 24 constituting a receiving reservoir forming part of the doctor blade assembly, the adhesive flowing in through a flow passage 23 communicating with the rear of said slot. Immediately above the slot which constitutes the receiving reservoir, there are located three closely spaced grooves 26 in the part-circular face of the doctor blade assembly. Immediately above said grooves there is a further slot 28 which forms an adhesive return reservoir. Above and below each groove 26 there are narrow lands which constitute primary doctor blades 30 closely spaced from the operative part of the applicator roller 16. A part of the assembly immediately above the slot 28 forming the adhesive return reservoir constitutes a final doctor blade 32.

It will be understood that, as shown by the arrows in FIG. 2, the adhesive picked up by the pick-up disc 20 is forced inwardly along the receiving reservoir and is dragged into the narrow gaps formed between the primary doctor blades and the operative surface of the roller. The adhesive is made to flow laterally, that is to say along the slot 24 to extend across the full width of the applicator roller, by the force of the adhesive flow up the U-shaped element 22. The adhesive which flows into the return reservoir 28 is able to flow directly back into the reservoir of adhesive in the tank from an end of said return reservoir remote from the pick-up disc 20.

As indicated by chain-dotted lines in FIG. 1, a top cover shrouds the upstanding portion of the pick-up disc 20.

A particular advantage of adhesive applicator apparatus as described above is that the pick-up disc will tend to aerate the adhesive in the tank to a far lesser extent than a conventional pick-up roller. It will also be understood that the adhesive being used at any time is that at the pick-up disc end of the tank 12. The adhesive in the tank is replenished by the level control assembly 14 at the opposite end of the tank so that there will tend to be no build-up of aerated adhesive in the tank.

Referring now to FIG. 3, this illustrates a detail of the applicator roller 16. As shown, the roller has plain bands 34 at each end. The doctor blade bears against said plain bands so that adhesive is not distributed on these parts of the roller. In addition, the roller has a central circumferential line 36 of the same diameter as the plain bands 34 so that this also is wiped clean by the doctor blade. The areas of the roller between the central circumferential line 36 and the respective plain bands 34 are of very slightly smaller diameter than said bands and central line, the arrangement being such that throughout the operation of the apparatus there is produced an even coating of adhesive on those areas of the roller, the thickness of the coating depending on the spacing of the doctor blade therefrom, that is to say on the depth of the areas between the line 36 and bands 34.

However, in addition to the plain bands 34 and central circumferential line 36 at the doctor blade contacting diameter of the roller there are two ridges 38, these extending in chevron fashion from the central circumferential line 36 as shown. The purpose of these angled ridges is to act as sweeper elements which will act on any particles of material, be they of grit or of solidified adhesive, which might otherwise become lodged in the gap between the operative part of the roller and the doctor blade. Such particles of material acted on by said angled ridges are quickly swept towards the opposite ends of the roller from where they are returned to the bottom of tank 12.

Possible Modifications

Figure 7:
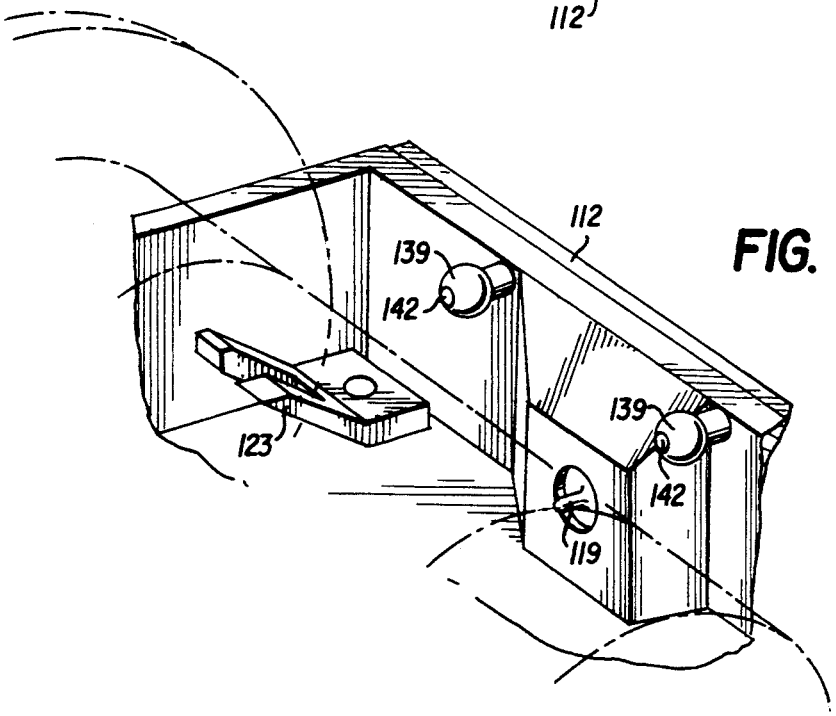
FIG. 7 is a perspective view looking into an adhesive tank forming part of this embodiment.

Referring now to FIGS. 4 to 7, in a modified form of the invention basically similar to that described above the doctor blade assembly 118 is located in the adhesive tank 112 by means of pivotal mounting means comprising a pair of laterally spaced ball and socket arrangements generally indicated 140. Each ball and socket arrangement 140 comprises a ball member 139 formed on a wall of the tank and a socket formation 141 formed on the doctor blade assembly 118. Each socket formation includes a ring 143 of an elastomeric material, the arrangement being such that when the socket formations have been pressed onto the respective ball members, they are retained thereon by the resilience of the rings 143.

The doctor blade assembly is acted on in a lower region by resilient means comprising a slidably located abutment member 119 acted on by a coil compression spring 121. The doctor blade assembly in this case is provided with slipper elements 115 at each end which act against abutment surfaces 117 at the opposite ends of the operative part of the applicator roller 116. In this embodiment, the doctor blade assembly is formed with a slot 124 constituting a receiving reservoir and immediately above it a further slot 128 which forms an adhesive return reservoir. A part of the assembly immediately above the slot 128 forming the adhesive return reservoir constitutes a final doctor blade 132. There is but a single primary doctor blade 130 between the slots 124 and 128 which form the receiving and return reservoirs.

The pick-up disc 120, which is associated with the applicator roller to rotate with it, is located in close proximity to one end of the doctor blade assembly. The arrangement is such that the adhesive which is picked up on the adjacent flank of said disc is dragged into the gap between disc and doctor blade and is able to flow into the open end of the slot 124 constituting the receiving reservoir. The adhesive is caused to flow along the slot by the pressure of the adhesive in the gap between the pick-up disc and doctor blade assembly.

In this embodiment of the invention there is a pick-up limiting doctor blade 123 of bifurcated form associated with the pick-up disc 120, this being so closely spaced from both the periphery and from the flank of said pick-up disc adjacent the doctor blade assembly 118 that the rate of flow of adhesive into the slot 124 constituting the receiving reservoir is limited and only slightly in excess of that required to coat the paper web contacting the applicator roller. Consequently, the amount of adhesive being returned from the doctor blade assembly 118 to the pool of adhesive in the tank is relatively small. (The arrow beneath the pick-up limiting doctor blade in FIG. 6 indicates the way in which the adhesive picked up by the pick-up disc is caused to be spread thinly and evenly on the flanks of said disc. This view also indicates the facility with which, when the pick-up disc top cover and the applicator roller and associated disc have been removed the doctor blade assembly 118 can very easily be removed for cleaning of the apparatus).

As indicated by arrows in FIG. 4, adhesive return passages 142 extend through the ball and socket arrangements 140 and connect the adhesive return reservoir formed by the slot 128 to an adhesive return port 144 which opens below the level of the adhesive in the tank.

Thus there is provided adhesive applicator apparatus which it has beer, found can operate for long periods of time without being prone to problems caused by aeration of the adhesive. The fact that aeration of the adhesive can only be caused by the relatively narrow pick-up disc entering the pool of adhesive in the tank reduces aeration significantly. The fact that in the FIG. 4 to 7 construction the amount of adhesive being fed to the receiving reservoir of the doctor blade assembly is controlled by the pick-up limiting doctor blade associated with the pick-up disc results in a relatively small amount of adhesive being returned to the adhesive tank throughout the operation of the device and contributes to the overall reduction of aeration of the adhesive. It has also been found that apparatus embodying the invention is tolerant of wide ranging variations of viscosity of adhesive being used, that is to say works well with a number of different adhesives.

Various modifications may be made. For example, while it will generally be most convenient for the pick-up disc to be associated with the applicator roller and to rotate with it, this is not essential. The pick-up disc could be separately mounted, and driven from the applicator roller for example, while still being arranged to feed adhesive to the receiving reservoir forming part of the doctor blade assembly. In this way the pick-up disc need not project above the applicator roller.

A pick-up limiting doctor blade could be fitted to the apparatus illustrated in FIGS. 1 to 3. Likewise, the applicator roller of the FIG. 4 to 7 embodiment could be provided with at least one angled ridge acting to sweep sideways any particles of material which might otherwise become lodged in the gap between the operative part of said roller and the doctor blade assembly, as illustrated in FIGS. 1 and 3. Although for the purpose of simple illustration the ridges 38 in FIGS. 1 and 3 are shown to be continuous ridges, this is not essential and it will be understood that the or each angled ridge could be a discontinuous ridge composed of a plurality of angled ridge elements at circumferentially spaced locations around the applicator roller, successive ridge elements overlapping each other across the operative part of said roller.

It will be understood that while an adhesive applicator embodying the invention is especially useful in association with cigarette making machinery it is not exclusively for such use. An applicator apparatus embodying the invention could be used in the cardboard box making industry for example.

I claim:

1. Adhesive applicator apparatus including a rotatable applicator roller, an adhesive tank for the supply of adhesive to the roller and at least one doctor blade operatively associated with said applicator roller, the applicator roller being located above the level of adhesive in said tank and the apparatus also including an adhesive pick-up disc on a common rotary axis with said applicator roller, laterally offset from said roller and depending to a lower level than said roller for feeding adhesive in the tank to a receiving reservoir for applying the adhesive to the roller at a region of the path of rotation of the roller preceding said at least one doctor blade.

2. Adhesive applicator apparatus including a rotatable applicator roller, an adhesive tank for the supply of adhesive to the roller and at least one doctor blade operatively associated with said applicator roller, the applicator roller being located above the level of adhesive in said tank and the apparatus also including an adhesive pick-up disc laterally offset from said roller and depending to a lower level than said roller for feeding adhesive in the tank to a receiving reservoir means for applying the adhesive to the roller at a region of the path of rotation of the roller preceding said at least one doctor blade, said receiving reservoir means comprising a pair of reservoir chambers disposed on opposite sides of said at least one doctor blade in the direction of rotation of the roller, a leading one of said chambers providing a receiving reservoir for the supply of adhesive to the roller and a trailing one of said chambers providing a return reservoir for surplus adhesive from the roller.

3. Adhesive applicator apparatus according to claim 2, including at least one groove between slots which form the receiving reservoir and the return reservoir, the primary doctor blades comprising lands which are located above and below at least one groove, and a final doctor blade located above the slot forming the adhesive return reservoir.

4. Adhesive applicator apparatus according to claim 1, including a U-shaped element operatively associated with a part of the pick-up disc, said U-shaped element forming a channel for the flow of adhesive in to a slot comprising the receiving reservoir.

5. Adhesive applicator apparatus according to claim 1, including an adhesive pick-up limiting doctor blade of bifurcated form operatively associated with the pick-up disc.

6. Adhesive applicator apparatus according to claim 1, including pivotal mounting means for said at least one doctor blade within the adhesive tank and resiliently mounted abutment means acting against at least one doctor blade.

7. Adhesive applicator apparatus according to claim 6, including at least two doctor blades and at least two laterally spaced ball and socket means within the adhesive tank, said ball and socket means comprising the pivotal mounting means for the doctor blades.

8. Adhesive applicator apparatus according to claim 6, including adhesive return passages extending through the pivotal mounting means to a lower region of the adhesive tank.

9. Apparatus according to claim 1, in which replenishment means for said adhesive tank are located adjacent one axial end of said roller remote from said laterally offset pick-up disc.

10. Adhesive applicator apparatus according to claim 1, in which the applicator roller is provided with at least one angled ridge extending across an operative part of the applicator roller, at the doctor blade contacting diameter of said roller, for sweeping sideway particles of material reaching said operative part.

11. Adhesive applicator apparatus according to claim 10, in which there is at least one pair of angled ridges extending in chevron fashion along the applicator roller.

* * * * *